US010492553B2

(12) United States Patent
Zhou et al.

(10) Patent No.: US 10,492,553 B2
(45) Date of Patent: Dec. 3, 2019

(54) NEGATIVE ION GENERATOR AND NEGATIVE ION FUNCTIONAL HAT

(71) Applicant: Zhejiang Yangling Healthcare Technology Co,. Ltd., Jinhua (CN)

(72) Inventors: Hongwei Zhou, Jinhua (CN); Yun Ni, Jinhua (CN); Zhenyu Xu, Jinhua (CN); Na Zhao, Jinhua (CN)

(73) Assignee: Zhejiang Yangling Healthcare Technology Co., Ltd., Jinhua (CN)

( * ) Notice: Subject to any disclaimer, the term of this patent is extended or adjusted under 35 U.S.C. 154(b) by 0 days.

(21) Appl. No.: 15/956,766

(22) Filed: Apr. 19, 2018

(65) Prior Publication Data

US 2019/0269189 A1 Sep. 5, 2019

(30) Foreign Application Priority Data

Mar. 2, 2018 (CN) ..... 2018 1 0176000

(51) Int. Cl.
*A42B 1/24* (2006.01)
*A62B 7/00* (2006.01)

(52) U.S. Cl.
CPC . *A42B 1/24* (2013.01); *A62B 7/00* (2013.01)

(58) Field of Classification Search
CPC .... A42B 1/24; A62B 7/00; H01J 27/02; H01J 27/028; H01T 23/00
See application file for complete search history.

(56) References Cited

U.S. PATENT DOCUMENTS 3,943,407 A * 3/1976 Bolasny ..... F01N 3/0892 361/229
2003/0011956 A1* 1/2003 Aiki ..... H01T 23/00 361/230

FOREIGN PATENT DOCUMENTS

CN 202889202 U * 4/2013
CN 106263214 A * 1/2017
CN 106263214 A 1/2017

* cited by examiner

*Primary Examiner* — David E Smith
(74) *Attorney, Agent, or Firm* — Schwegman Lundberg & Woessner, P.A.

(57) ABSTRACT

This invention provides a negative ion generator and a negative ion functional hat, and the negative ion generator is connected in series with a power regulation module. Through the control of a power control device to the power regulation module, the number of negative ions generated by a negative ion generation module is regulated. The negative ion functional hat provided by this invention is provided with the above-mentioned negative ion generator. Negative ion emission power can be regulated in conjunction with an active state of a human body, thereby allowing negative ion emission amount to be adapted to actual human body demand.

11 Claims, 1 Drawing Sheet

NEGATIVE ION GENERATOR AND NEGATIVE ION FUNCTIONAL HAT

CROSS-REFERENCE TO RELATED APPLICATIONS

This Non-provisional application claims priority under 35 U.S.C. § 119(a) on Patent Application No(s). 201810176000.5 filed in People's Republic of China on Mar. 2, 2018, the entire contents of which are hereby incorporated by reference.

BACKGROUND OF THE INVENTION

Field of the Invention

This invention relates to a negative ion generation device, and more particularly to a negative ion generator and a negative ion functional hat.

Description of the Related Art

A Chinese patent application CN106263214A provides a standard smog-proof hat with a big brim, which is provided with a negative ion generator at a front end of a hat top. The negative ion generator has an negative ion generator main body, a control module, and negative ion emission heads installed at both sides of a back surface of the hat brim. Different from the conventional smog-proof protective hat, the Chinese patent application CN106263214A introduces a positive electrode of the negative ion generator in the form of a rivet-like metal piece or a copper foil, leaving a certain distance between the positive electrode and the negative ion emission head. The principle of this kind of structure is to form a loop between the negative ion emission head and the positive electrode through the air within a given distance as a medium, thereby forming a negative ion current emitted from top to down on a face.

When the patent application document CN106263214A adopts the copper foil, the copper foil is disposed at a sweatband on the front side of a hat wall, such that negative charges emitted by the negative ion emission head pass through the sweatband, an attached leather fabric, the copper foil and the human body to form a loop. The human body forms the positive electrode, which can make the dispersion of negative ions more directional, thereby improving the utility of negative ion generator. However, a wearer needs different amounts of inhaled gas at different stages. It can be understood that the difference in oxygen consumption between sitting and exercising states will be relatively large. For the wearer, it is expected that the oxygen demand is positively correlated with the power of the negative ion generator. It is clear that the above-mentioned patent application document CN106263214A does not have the effect of automatically regulating the power of the negative ion generator.

BRIEF SUMMARY OF THE INVENTION

To solve above-mentioned technical problems, this invention provides a negative ion generator, and this negative ion generator is connected in series with a power regulation module. The number of negative ions generated by the negative ion generation module is achieved by triggering a trigger signal to the power regulation module. This invention further provides a negative ion functional hat, and this negative ion functional hat adopts above-mentioned negative ion generator. Negative ion emission power can be regulated in conjunction with an active state of a human body, thereby allowing negative ion emission amount to be adapted to actual human body demand.

To achieve above-mentioned objectives, the specific solution of this invention is as follows.

One embodiment of this invention provides a negative ion generator including a negative ion output end, a negative ion generation module and a power regulation module sequentially connected, the power regulation module includes a gain circuit, and the gain circuit is provided with a control end; and the control end receives a power regulation signal and regulates a gain coefficient of the power regulation module according to the power regulation signal so as to regulate power of an oscillating circuit such that negative ion emission amount of an output end of the negative ion generator changes with trigger information.

Further, the gain circuit may include a triode, an emitter electrode and a collector of the triode may be connected in series with the oscillating circuit, and a base electrode of the triode may be the control end.

As a preferred solution, the base electrode may be connected in series with a protective resistor.

As a preferred solution, the base electrode may be connected in series with a protective capacitor.

Another embodiment of this invention provides a negative ion functional hat, the negative ion functional hat includes a functional hat main body, a negative ion generator is disposed in the functional hat main body, and the functional hat main body is provided with a power control device; and the negative ion generator is connected with the power control device and regulates negative ion emission amount according to a power regulation signal sent by the power control device.

As a preferred solution, a negative ion output end of the negative ion generator may include at least two negative ion emission heads, and each negative ion emission head may be disposed along a lower surface edge of a hat brim of the functional hat main body:

when a number of the negative ion emission heads is even, all negative ion emission heads are divided into two groups, and two groups of the negative ion emission heads are symmetrical about a left-right-middle profile of the negative ion functional hat on the hat brim of the negative ion emission head; and when the number of the negative ion emission heads is odd, one is set on the left-right-middle profile of the negative ion functional hat, the other negative ion emission heads are divided into two groups, and two groups of the negative ion emission heads are symmetrical about the left-right-middle profile of the negative ion functional hat on the hat brim of the negative ion emission head.

As a preferred solution, a switch may be disposed between the power control device and a control end of a gain circuit in the negative ion generator, and the switch may be configured to control turn-on and turn-off between the power control device and the control end.

Further, the switch may be a single-pole double-throw, a pole end of the single-pole double-throw may be connected with the control end, one of the two output ends may be connected with the power control device, and the other may be hung in the air. Preferably, the single-pole double-throw switch selects a toggle switch As a preferred solution, the power control device may be a conductive sheet embedded at a forehead portion of the functional hat main body, and the conductive sheet may be connected with the control end of the negative ion generator. A potential of the control end may be regulated by a change of a coupling capacitor between the conductive sheet and a human body, so as to change a gain value of the gain circuit such that the negative ion emission amount fit an active state of the human body.

As a preferred solution, the conductive sheet may be a metal sheet, and an inner surface may be covered by a fabric.

Compared with the prior art, beneficial effects of this invention are:

1) Through cooperation of the power regulation module and the power control device, this invention can not only improve a generation efficiency of negative ions, but also regulate the negative ion emission power, such that the emission amount of negative ions can be adapted to actual demand of a wearer, and a stability of the circuit is high; at the same time, regulating the negative ion emission amount according to the active amount of the wearer improves a health protection effect of the negative ion functional hat.

2) An internal circuit of the negative ion generator provided by this invention not only has less loops, but also has a shorter path, which is less affected by an external environment, and the loops are smooth, such that a stability of a negative ion atmosphere is relatively good.

BRIEF DESCRIPTION OF THE DRAWINGS

The accompanying drawings constituting a part of this application are used to provide a further understanding of this application, and exemplary embodiments of this application and the description thereof are used to explain this application and do not limit this application.

In the figures: 1. cabin portion, 2. hat, 3. wiring tube, 4. negative ion emission head, 5. display screen, 6. toggle switch, 7. power switch, 8. hat ring, and 9. forehead portion.

DETAILED DESCRIPTION OF THE INVENTION

This invention will be further described below with reference to the accompanying drawings and embodiments.

It should be noted that the following detailed description is illustrative and is intended to provide further explanation of this application. Unless defined otherwise, all technical and scientific terms used herein have the same meaning as commonly understood by those skilled in the art to which this application belongs.

It should be noted that the terminology used herein is merely used to describe a specific embodiment, but is not intended to limit the exemplary embodiment according to this application. As used herein, unless the context clearly indicates, otherwise singular forms are intended to include plural forms as well. In addition, it should be understood that when terms "comprising" and/or "including" are used in this application, they indicate features, steps, operations, devices, assemblies, and/or combinations thereof.

Embodiment One

A conventional DC negative ion generator is a complete loop formed by electrons emitted from a high-voltage discharge end (corona end) passing through air, ground, a zero line of an AC power supply system, an AC and DC conversion system, and a power supply end of a DC negative ion generator. However, in the process of AC and DC conversion, isolation transformers and protective capacitors obstruct a smoothness of the loop; in addition, this loop system (corona end electron of the DC negative ion generator→air→ground→zero line of the AC power supply system→AC and DC conversion system→power supply end of the DC negative ion generator) has too many intermediaries, and stability and an impedance between each system change at any time, which will result in an instability of the negative ion amount under the same corona high-voltage, and weakening of motion patency of electrons in an impedance change. In particular, when the conventional DC negative ion generator is applied to a portable wearable product, an undesirable concentration of the negative ions may occur due to relatively low power of the generator, a long distance from the positive pole of the earth, and a poor circuit.

Figure 1:
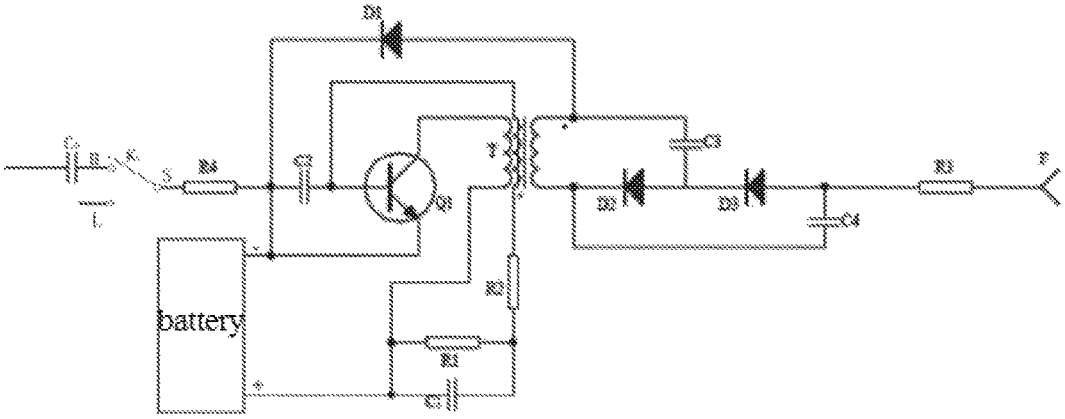
FIG. 1 is an electrical schematic diagram of a negative ion generator according to one embodiment of this invention.

As shown in FIG. 1, the negative ion generator according to one embodiment of this invention includes a negative ion output end, a negative ion generation module, and a power regulation module connected in sequence. Specifically, the negative ion generation module includes an oscillating circuit portion for generating an AC signal, a transformer T for rising the voltage (a primary coil of the transformer T constitutes a coil of the oscillating circuit, or an inductive element, and a secondary coil of the transformer is an output coil) and rectifier circuit portion formed by diodes D2 and D3. The rectifier circuit portion rectifies output of the secondary coil, in turn a filter circuit formed by capacitors C3 and C4 filters the rectified electric signal to finally form a DC negative pulse high-voltage (5,000 to 10,000 volts). The DC negative pulse high-voltage is connected with the negative ion output end which is the emission head F through a protective resistor R3, and a discharge needle on the emission head F discharges to the air to generate negative ions.

Among them, the oscillating circuit is a core of the negative ion generator. Cores of the oscillating circuit is the capacitor C1 and the primary coil of the transformer T connected in series with the capacitor C1, and additional components such as a current-limiting resistor R2.

The power regulation module includes a gain circuit, such as the triode Q1 in FIG. 1, which is a basic element of the gain circuit. The gain circuit constructed by single triode Q1 is the most basic gain circuit in an analog circuit category, and the gain circuit can better achieve the corresponding objective compared with other types of gain circuits. Therefore, the gain circuit will be described below, and those skilled in the art are motivated to use other types of gain circuits for the most basic gain circuit so as to achieve a better objective and be predictable.

Adopting the negative ion generator shown in FIG. 1, compared with a conventional negative ion generator, the negative ion generator not only has less loops, but also has a shorter path, which is less affected by an external environment, and the loops are smooth, such that a stability of a negative ion atmosphere is relatively good. Specifically, according to an embodiment of this invention, the loop path of the electrons at the corona end is changed. An electron beam generated by the emission head F passes through the air, and then passes through the positive pole sheet of the DC negative ion generator to the generator to form a virtual loop. This method effectively improves the problem of poor smoothness of the electron beam loop. It has been experimentally proven that under the same corona high-voltage and atmospheric conditions, the concentration of negative ions generated by DC negative ion generator increases by more than 80% relative to the conventional DC negative ion generator.

In addition, compared to the conventional negative ion generator, in this embodiment, the oscillating circuit of the negative ion generator is connected in series with a gain circuit whose control end is the end that the negative ion generator main body is coupled with the ground. Through the circuit gain, the generation efficiency of the negative ions can be improved, such that the wearer can still guarantee a relatively high concentration of negative ions in a relatively small range.

It should be noted that the gain circuit is an amplification circuit, its gain coefficient is abbreviated as gain, and its variation depends on, for example, the potential of the base electrode of the triode Q1. Therefore, for example, in a circuit with single triode Q1 as an amplification element, the control end for controlling the gain is the base electrode of the triode Q1. Based on the principle of this invention, it is expected that the emission power of the negative ion generator can be increased when the person wearing the negative ion functional hat is in intense activity. It is known that when the activity of a person is intense, the body surface temperature will increase first, and if sweating occurs, a body resistor will decrease, and a contact resistor between some components and the human body will also be affected.

Embodiment Two

When the negative ion generator is applied to the negative ion functional hat, the principle thereof is: including a functional hat main body as shown in FIG. 1, wherein the functional hat main body is provided with a hat ring 8, a forehead portion 9, a hat brim 2 and so on. The hat brim 2 usually has a certain rigidity and has a certain ability to resist deformation. Therefore, for the conductive sheet, for example, the forehead portion 9 may adopt a relatively brittle material such as a graphite plate if the forehead portion 9 itself has a relatively large rigidity.

In FIG. 1, $C_0$ is the coupling capacitor between the metal sheet and a human forehead. When a surface temperature of the human body rises, a head circumference also changes slightly, which will increase the coupling capacitor. The potential of the base electrode is increased, the gain is increased, and the emission head F emits more negative ions.

In order to form the coupling capacitor, a metal sheet is disposed in the fabric of the negative ion functional hat corresponding to the human forehead portion, and the metal sheet can occupy a relatively larger area, such that the coupling capacitor has a relatively large capacity.

For the metal sheet, other conductive sheets with certain toughness can also be used to instead. The toughness here is to adapt to the deflection caused by a normal wearing of the negative ion functional hat without causing breakage.

For the conductive sheet, metal sheet with a relatively high conductivity such as a copper sheet, an aluminum sheet, or an iron sheet is preferable. Wherein the copper sheet has the best electrical conductivity in these three, and can be made into a form of a copper foil. For the aluminum sheet, the conductivity is medium, but its density is the smallest, which can effectively reduce the weight of the negative ion functional hat. While for the iron sheet, the price is the lowest and the electrical conductivity is relatively good.

Figure 2:
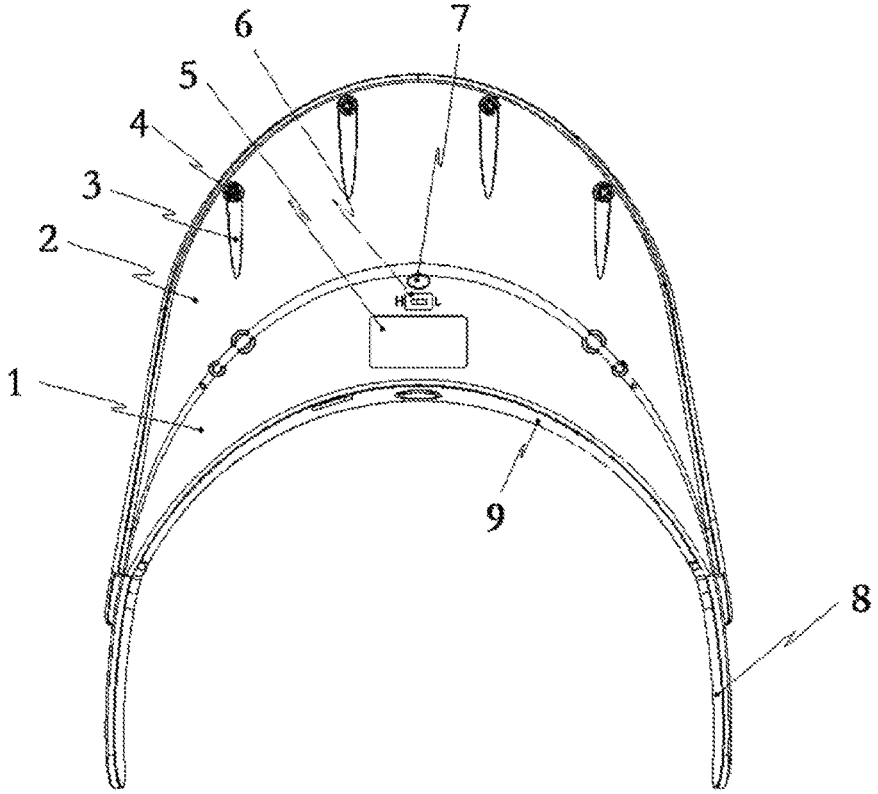
FIG. 2 is a structural schematic diagram of a negative ion functional hat according to one embodiment of this invention.

From FIG. 2, in a wedge portion formed by the hat brim 2 and the hat ring 8, a cabin cover is added to form the cabin portion 1 as shown in FIG. 2. The cabin portion 1 holds a main body portion of the negative ion generator, while the emission heads 4 are led out through wiring tubes 3 as shown in FIG. 1. In FIG. 1, the emission heads 4 are distributed on the lower surface edge of the hat brim 2, and the emission heads 4 may have an angle of inclination toward a wearer's face, or may be disposed downward.

The volume of the negative ion generator is generally relatively small, and the equipped battery is the device with the largest weight among them. Therefore, the battery is disposed at the side of the forehead portion 9 of the cabin portion 1, and a circuit board can be disposed at the front side of the battery.

For the battery, a soft lithium battery is preferable, and it is a kind of rechargeable battery. Its package structure is easy to form a certain degree of curvature, thereby fitting the curvature of the forehead portion 9.

The hat ring 8 in FIG. 2 is a substantially U-shaped open ring. In some embodiments, a closed hat ring structure may also be used. For the closed hat ring structure, it is possible to provide an adjustable structure such as a hook and loop or the like at the back side of the hat ring 8.

FIG. 1 is a bottom view structure of the negative ion functional hat. In the figure, a display screen 5 is provided at an outer wall surface (outer surface of a bottom wall) of the cabin portion 1 and can be used to display some environmental data.

The human body is substantially a symmetrical structure, and most of clothes are the same structure. This structure is also used in the negative ion functional hat shown in FIG. 2, which is adapted to a left-right-middle profile and is recorded as a left-right symmetry plane.

Four emission heads are shown in FIG. 1, and two of them are as one group disposed at both sides of the left-right-middle profile. The two groups of emission heads are symmetry about the left-right-middle profile.

For the emission heads 4, the number is at least two, and at most no more than six. When the number of the emission heads 4 is odd, one is disposed at the left-right-middle profile, the rest is divided into two groups, and the two groups are symmetrical about the left-right-middle profile.

In the structure shown in FIG. 2, the negative ion functional hat is equipped with a power switch 7 and a toggle switch 6, wherein the power switch 7 is a master switch and can be disposed at the side of a positive pole of the battery in FIG. 1. K1 shown in FIG. 1 represents the toggle switch 6. Specifically, in FIG. 1, the pole end of K1, that is, S end in FIG. 1 is connected with the base electrode of the triode Q1. H end is connected with C0, that is, is connected with the coupling capacitor, and L end is hung in the air.

According to the above-mentioned structure, when the pole end of the toggle switch 6 is turned to H end, the whole gain circuit is conductive, and the wearer's forehead is coupled with the positive pole sheet (i.e., the conductive sheet) at the position corresponding to the forehead portion 9 through the fabric, which can achieve a maximum gain effect.

When the toggle switch 6 is turned to L end, that is, a hanging-in-the-air end, a positive pole guide wire of the gain circuit is disconnected at this time, but a frequency of the gain circuit can still be coupled with the positive pole sheet through air.

In a preferred embodiment, the distance between the hanging-in-the-air end and the positive pole sheet is 2 mm. According to actual measurement, after the positive pole guide wire and the electrode sheet are disconnected by the toggle switch 6 to a distance of 2 mm, the concentration of emitted negative ions is 70-80% of that in a condition of directly conducting, thereby achieving the purpose of manually regulating the concentration of negative ions.

The toggle switch 6 is a kind of single-pole double-throw switch. The toggle switch has a small volume, and a toggle structure has little influence on an appearance of the negative ion functional hat.

To sum up, compared with a conventional negative ion generator, the negative ion generator provided by this invention not only has less loops, but also has a shorter path, which is less affected by an external environment, and the loops are smooth, such that a stability of a negative ion atmosphere is relatively good. By adding the power regulation module, this invention can not only improve a generation efficiency of negative ions, but also regulate the negative ion emission power, such that the emission amount of negative ions can be adapted to actual demand of a wearer, and a stability of the circuit is high; at the same time, regulating the negative ion emission amount according to the active amount of the wearer improves a health protection effect of the negative ion functional hat.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A Direct Current negative ion generator comprising a negative ion output end, a negative ion generation module and a power regulation module sequentially connected, the negative ion generation module including a rectifier circuit configured to convert Alternative Current to Direct Current;

the power regulation module comprising a gain circuit, wherein the gain circuit is provided with a control end;

wherein the control end receives a power regulation signal and regulates a gain coefficient of the power regulation module according to the power regulation signal so as to regulate power of an oscillating circuit such that negative ion emission amount of an output end of the negative ion generator changes with trigger information; and a loop comprising a path of an electron beam emitted from the output end, passing through a positive pole sheet of the Direct Current negative ion generator to the negative ion generation module.

2. The negative ion generator according to claim 1, wherein the gain circuit comprises a triode, an emitter electrode and a collector of the triode are connected in series with the oscillating circuit, and a base electrode of the triode is the control end.

3. The negative ion generator according to claim 2, wherein the base electrode is connected in series with a protective resistor.

4. The negative ion generator according to claim 2, wherein the base electrode is connected in series with a protective capacitor.

5. The negative ion generator according to claim 3, wherein the base electrode is connected in series with a protective capacitor.

6. A negative ion functional hat comprising a functional hat main body, wherein a negative ion generator described according to claim 1 is disposed in the functional hat main body, and the functional hat main body is provided with a power control device; and wherein the negative ion generator is connected with the power control device and regulates negative ion emission amount according to a power regulation signal sent by the power control device.

7. The negative ion functional hat according to claim 6, wherein a negative ion output end of the negative ion generator comprises at least two negative ion emission heads, and each negative ion emission head is disposed along a lower surface edge of a hat brim of the functional hat main body:

when a number of the negative ion emission heads is even, all negative ion emission heads are divided into two groups, and two groups of the negative ion emission heads are symmetrical about a front-to-back line passing through the center of the negative ion functional hat; and when the number of the negative ion emission heads is odd, one is set on the front-to-back line passing through the center of the negative ion functional hat, the other negative ion emission heads are divided into two groups, and two groups of the negative ion emission heads are symmetrical about the front-to-back line passing through the center of the negative ion functional hat.

8. The negative ion functional hat according to claim 6, wherein a switch is disposed between the power control device and a control end of a gain circuit in the negative ion generator, and the switch is configured to control turn-on and turn-off between the power control device and the control end.

9. The negative ion functional hat according to claim 8, wherein the switch is a single-pole double-throw, a pole end of the single-pole double-throw is connected with the control end, one of the two output ends is connected with the power control device, and the other is hung in the air.

10. The negative ion functional hat according to claim 6, wherein the power control device is a conductive sheet embedded at a forehead portion of the functional hat main body, the conductive sheet is connected with the control end of the negative ion generator, and a potential of the control end is regulated by a change of a coupling capacitor between the conductive sheet and a human body, so as to change a gain value of the gain circuit such that the negative ion emission amount fit an active state of the human body.

11. The negative ion functional hat according to claim 10, wherein the conductive sheet is a metal sheet, and an inner surface is covered by a fabric.

* * * * *